US009593461B2

(12) United States Patent
Faivre et al.

(10) Patent No.: US 9,593,461 B2
(45) Date of Patent: Mar. 14, 2017

(54) WORK TOOL PITCH CONTROL SYSTEM FOR A MACHINE

(71) Applicant: Caterpillar Inc., Peoria, IL (US)

(72) Inventors: Joseph Leo Faivre, Edelstein, IL (US); Nathaniel Steven Doy, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 347 days.

(21) Appl. No.: 14/280,875

(22) Filed: May 19, 2014

(65) Prior Publication Data

US 2015/0330057 A1 Nov. 19, 2015

(51) Int. Cl.

| | |
|---|---|
| ***E02F 3/84*** | (2006.01) |
| ***E02F 9/22*** | (2006.01) |
| ***E02F 3/76*** | (2006.01) |

(52) U.S. Cl.

CPC ..... *E02F 3/844* (2013.01); *E02F 3/7618* (2013.01); *E02F 9/2221* (2013.01); *E02F 9/2278* (2013.01); *F15B 2211/3059* (2013.01); *F15B 2211/6336* (2013.01); *F15B 2211/7107* (2013.01); *F15B 2211/782* (2013.01)

(58) Field of Classification Search

CPC combination set(s) only.

See application file for complete search history.

(56) References Cited

U.S. PATENT DOCUMENTS

| | | | | |
|---|---|---|---|---|
| 5,551,518 | A * | 9/1996 | Stratton | E02F 3/845 172/4.5 |
| 5,622,226 | A * | 4/1997 | Hausman | E02F 3/844 172/12 |
| 5,862,868 | A | 1/1999 | Yamamoto et al. | |
| 5,875,854 | A | 3/1999 | Yamamoto et al. | |
| 6,035,241 | A * | 3/2000 | Yamamoto | E02F 3/844 172/45 |
| 8,141,650 | B2 | 3/2012 | Breiner et al. | |
| 2009/0223688 | A1 | 9/2009 | Hendron et al. | |
| 2012/0152575 | A1 * | 6/2012 | Hand | E02F 3/815 172/812 |

(Continued)

FOREIGN PATENT DOCUMENTS

| | | |
|---|---|---|
| WO | WO 00/36231 | 6/2000 |
| WO | WO 2014/024562 | 2/2014 |

*Primary Examiner* — Thomas G Black

*Assistant Examiner* — Ana Thomas

(74) *Attorney, Agent, or Firm* — Finnegan, Henderson, Farabow, Garrett & Dunner, LLP; James S. Bennin

(57) ABSTRACT

A control system for a machine is disclosed. The control system may have a first cylinder operatively connected between a first side of a work tool and an undercarriage of the machine, a second cylinder operatively connected between a second side of the work tool and the undercarriage of the machine, and one or more electro-hydraulic valves configured to selectively regulate flow of pressurized fluid to the cylinders. The control system may also have a controller configured to determine a difference between a desired pitch of the work tool and an actual pitch of the work tool, and compare the difference to a threshold value. The controller may also be configured to move the one or more electro-hydraulic valves to change the flow of pressurized fluid to at least one of the first and second cylinders to adjust the actual pitch of the work tool to the desired pitch, based on the comparison.

20 Claims, 2 Drawing Sheets

(56) References Cited

U.S. PATENT DOCUMENTS

| | | | | |
|---|---|---|---|---|
| 2014/0107896 | A1* | 4/2014 | Fehr | E02F 3/845<br>701/50 |
| 2014/0343800 | A1* | 11/2014 | Nelson | E02F 3/845<br>701/49 |

* cited by examiner

WORK TOOL PITCH CONTROL SYSTEM FOR A MACHINE

TECHNICAL FIELD

The present disclosure is directed to control system and, more particularly, to a work tool pitch control system for a machine.

BACKGROUND

Some earth moving machines, for example dozers, motor graders, and snow plows, have a front-mounted work tool such as a blade, bucket, or plow for pushing, carrying, and/or dumping material. These work tools can be tilted and pitched by paired cylinders located to either side of the work tool. Tilting may be accomplished by extending and retracting a single cylinder or extending one cylinder while retracting the other cylinder. Pitching can be separately accomplished by extending or retracting both cylinders in the same direction at the same time.

As a machine of this type operates, an operator and/or an automatic blade control system may tilt the work tool in one or more directions to perform one or more operations, such as to move material and/or steer the machine. In some instances, however, extension and retraction of one or more of the paired cylinders during a tilt operation may inadvertently change the pitch of the work tool. For example, left and right tilting of a dozer blade during a steering operation may gradually cause the blade to pitch outwardly, resulting in a more aggressive cutting edge angle. If the resulting work tool pitch is not adjusted, subsequent operation of the machine may be inefficient. If an operator recognizes that the pitch of the work tool is incorrect, the operator may have to manually adjust the pitch, complicating control of the machine and interrupting an operation that was being performed.

One example of a control system for adjusting the pitch of a work tool is disclosed in U.S. Pat. No. 5,862,868, which issued to Yamamoto et al. on Jan. 26, 1999 ("the '868 patent"). In particular, the '868 patent discloses a control system that automatically resets a bulldozer blade to a predetermined excavating pitch while the bulldozer is traveling backwardly, after it has completed an operation of excavating, carrying, or dumping earth. While the control system of the '868 patent may simplify control of a bulldozer blade, it does not address the problems caused by an inadvertent change in blade pitch. That is, even if a work tool (such as the bulldozer blade of the '868 patent) is automatically reset to a particular pitch when a machine has finished an operation (such as when the machine travels backwardly), any inadvertent changes in work tool pitch may have already had an effect and caused inefficient operation of the machine.

The present disclosure is directed to overcoming one or more of the problems set forth above and/or other problems of the prior art.

SUMMARY

In one aspect, the present disclosure is directed to a control system for a machine. The control system may include a first cylinder operatively connected between a first side of a work tool and an undercarriage of the machine, a second cylinder operatively connected between a second side of the work tool and the undercarriage of the machine, and one or more electro-hydraulic valves configured to selectively regulate flow of pressurized fluid to the first and second cylinders. The control system may also include a controller configured to determine a difference between a desired pitch of the work tool and an actual pitch of the work tool, and compare the difference to a threshold value. The controller may also be configured to move the one or more electro-hydraulic valves to change the flow of pressurized fluid to at least one of the first and second cylinders to adjust the actual pitch of the work tool to the desired pitch, based on the comparison.

In another aspect, the present disclosure is directed to a method of controlling a work tool. The work tool may be operatively connected to an undercarriage of a machine by a first cylinder and a second cylinder. The method may include measuring an actual cylinder displacement position of at least one of the first cylinder and the second cylinder. The method may also include determining a difference between a desired pitch of the work tool and an actual pitch of the work tool based at least on a current work tool mode and the actual cylinder displacement position, and comparing the difference to a threshold value. The method may further include moving one or more electro-hydraulic valves to change a flow of pressurized fluid to at least one of the first and second cylinders to adjust the actual pitch of the work tool to the desired pitch, based on the comparison.

DETAILED DESCRIPTION

Figure 1:
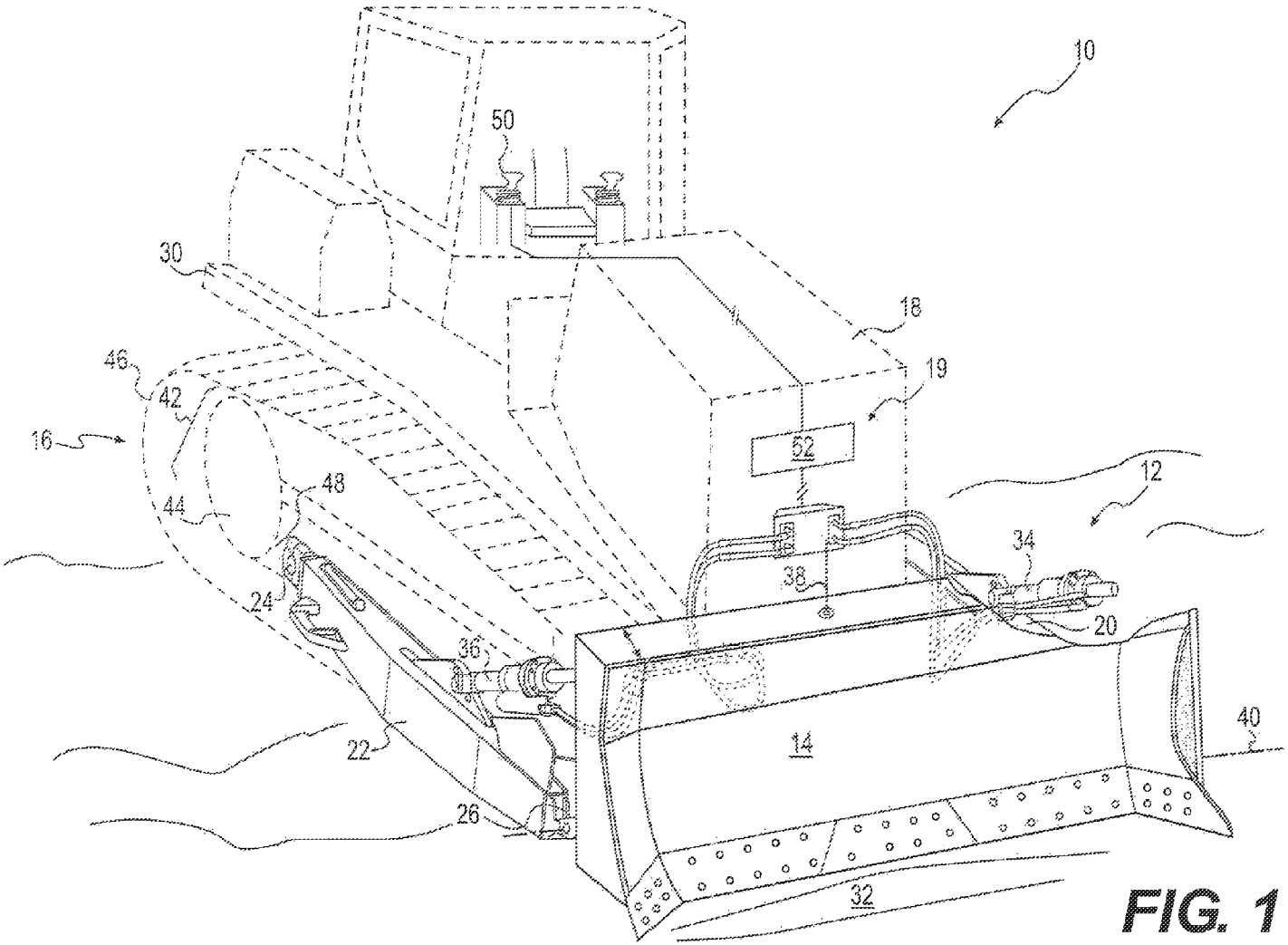
FIG. 1 is a pictorial illustration of an exemplary disclosed mobile machine.

FIG. 1 illustrates an exemplary machine 10 having multiple systems and components that cooperate to accomplish a task. Machine 10 may embody a mobile machine that performs some type of operation associated with an industry such as mining, construction, farming, transportation, or another industry known in the art. For example, machine 10 may be a material moving machine such as a dozer, a motor grader, a snow plow, or similar machine. Machine 10 may include an implement system 12 configured to move a work tool 14, a drive system 16 for propelling machine 10, a power source 18 that provides power to implement system 12 and drive system 16, and a control system 19 that provides for control of implement system 12, drive system 16, and/or power source 18.

Implement system 12 may include a linkage structure acted on by fluid actuators to move work tool 14. Specifically, implement system 12 may include left and right push anus 20, 22 that are pivotally connected at proximal ends 24 to drive system 16 and at opposing distal ends 26 to left and right base edges of work tool 14, respectively. A pair of opposing left and right hydraulic cylinders 34, 36 may be operatively connected between left and right upper edges of work tool 14 and center portions of left and right push arms 20, 22, respectively, to tilt and pitch work tool 14 relative to a frame 30, in particular, extension or retraction of hydraulic cylinders 34, 36 by differing amounts and/or in differing directions may function to tilt work tool 14 about a vertical axis 38. In contrast, the extension or retraction of both hydraulic cylinders 34, 36 by an equal amount in the same direction may function to pitch work tool 14 in a vertical plane about a horizontal axis 40.

Numerous different work tools 14 may be attachable to a single machine 10 and controllable by an operator and/or control system 19. Work tool 14 may include any device used to perform a particular task such as, for example, a blade, a bucket, a plow, or another task performing device known in the art. Although connected in the embodiment of FIG. 1 to pivot in the vertical and horizontal directions relative to frame 30 of machine 10, work tool 14 may additionally lift, slide, swing, or move in any other manner known in the art.

Drive system 16 may include opposing undercarriage assemblies 42 (only one shown in FIG. 1) that form part of an undercarriage of machine 10. Each undercarriage assembly 42 may have a sprocket 44 powered by power source 18 to rotate a corresponding endless track 46. Each undercarriage assembly 42 may also include a frame member 48 operatively connected to sprocket 44 and/or frame 30 to support the proximal end 24 of a corresponding one of left and right push arms 20, 22. It is contemplated that drive system 16 could alternatively include traction devices other than tracks 46 such as wheels, belts, or other known traction devices.

Power source 18 may embody an engine such as, for example, a diesel engine, a gasoline engine, a gaseous fuel-powered engine, or any other type of combustion engine known in the art. It is contemplated that power source 18 may alternatively embody a non-combustion source of power such as a fuel cell, a power storage device, or another known source. Power source 18 may produce a mechanical or electrical power output that is used to propel machine 10 via drive system 16 and can be converted to hydraulic power for moving hydraulic cylinders 34, 36.

Control system 19 may include components configured to provide manual and/or automatic control of implement system 12. For example, control system 19 may include one or more interface devices 50 and a controller 52. Interface devices 50 may be manipulated by an operator to initiate movement of machine 10 by producing proportional displacement signals that are indicative of desired maneuvering. In one embodiment, interface devices 50 may include a joystick associated with control of tilting and pitching movements of work tool 14. It is contemplated that an interface device 50 other than a joystick such as, for example, a pedal, a lever, a wheel, and other devices known in the art, may additionally or alternatively be provided within an operator station for movement control of machine 10, if desired.

Controller 52 may include a memory, a secondary storage device, a clock, and one or more processors that cooperate to accomplish a task consistent with the present disclosure. Numerous commercially available microprocessors can be configured to perform the functions of controller 52. It should be appreciated that controller 52 could readily embody a general machine controller capable of controlling numerous other functions of machine 10. Various known circuits may be associated with controller 52, including signal-conditioning circuitry, communication circuitry, and other appropriate circuitry. It should also be appreciated that controller 52 may include one or more of an application-specific integrated circuit (ASIC), a field-programmable gate array (FPGA), a computer system, and a logic circuit configured to allow controller 52 to function in accordance with the present disclosure.

Controller 52 may be configured to receive control signals from interface devices 50 and use the control signals to manipulate implement system 12 to achieve a desired effect. For example, controller 52 may be configured to extend and/or retract one or more of cylinders 34, 36 to tilt and/or pitch work tool 14 according to a tilt and/or pitch instruction received from interface devices 50. In addition, controller 52 may be configured to automatically control work tool 14, such as based on one or more stored automatic control programs. For example, controller 52 may be configured to automatically tilt and/or pitch work tool 14 as machine 10 performs an operation.

Figure 2:
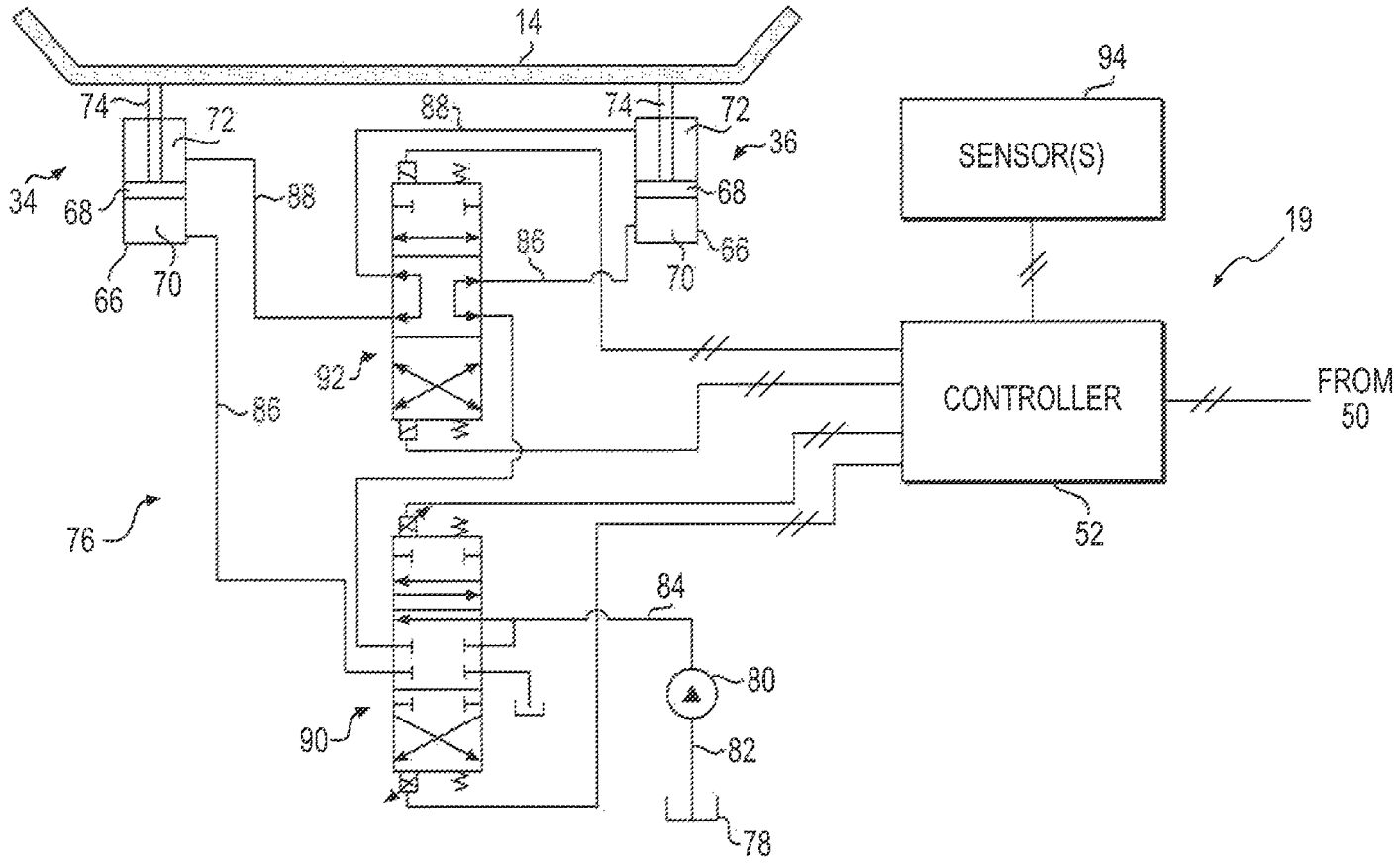
FIG. 2 is a schematic illustration of an exemplary disclosed hydraulic system that may be utilized with the machine of FIG. 1.

As shown in FIG. 2, each of hydraulic cylinders 34, 36 may include a tube 66 having a closed end operatively connected to one of push arms 20, 22 (referring to FIG. 1), and a piston assembly 68 having a rod 74 protruding through an open end of tube 66 for connection to work tool 14. Piston assembly 68 may be arranged with tube 66 to form a head-end pressure chamber 70 and a rod-end pressure chamber 72. Head- and rod-end pressure chambers 70, 72 may each be selectively supplied with pressurized fluid and drained of the pressurized fluid to cause piston assembly 68 and connected rod 74 to displace within tube 66, thereby changing an effective length of hydraulic cylinders 34 or 36. A flow rate of fluid into and out of head- and rod-end pressure chambers 70, 72 may relate to a velocity of hydraulic cylinders 34, 36, while a pressure differential between head- and rod-end pressure chambers 70, 72 may relate to a force imparted by hydraulic cylinders 34, 36 on work tool 14 (referring to FIG. 1).

Machine 10 may include a hydraulic system 76 having a plurality of fluid components that cooperate to cause the extending and retracting movements of hydraulic cylinders 34, 36 described above. Specifically, hydraulic system 76 may include a tank 78 holding a supply of fluid, and a primary source 80 configured to pressurize the fluid and selectively direct the pressurized fluid to each of hydraulic cylinders 34, 36. Primary source 80 may be connected to tank 78 via a tank passage 82, and to each hydraulic cylinder 34, 36 via a common supply passage 84 and separate head- and rod-end passages 86, 88. Tank 78 may be connected to each hydraulic cylinder 34, 36 via a common drain passage (not shown) and head- and rod-end passages 86, 88. Hydraulic system 76 may also include one or more valves located between hydraulic cylinders 34, 36 and tank 78 and primary source 80 to regulate flows of fluid through the corresponding passages (e.g., passages 84-88).

Primary source 80 may be configured to draw fluid from one or more tanks 78 and pressurize the fluid to predetermined levels. Specifically, primary source 80 may embody a pumping mechanism such as, for example, a variable displacement pump having a displacement actuator that adjusts a displacement of primary source 80 based on a pressure of fluid within a load sense passage, a fixed displacement pump (not shown) having are unloader valve that selectively reduces a load on primary source 80, or any other type of source known in the art. Primary source 80 may be connected to power source 18 of machine 10 by, for example, a countershaft, a belt (not shown), an electrical circuit (not shown), a reduction gear box (not shown), or in any other suitable manner.

Tank 78 may constitute a reservoir configured to hold a low-pressure supply of fluid. The fluid may include, for example, a dedicated hydraulic oil, an engine lubrication oil, a transmission lubrication oil, or any other fluid known in the art. One or more hydraulic systems within machine 101 may draw fluid from and return fluid to tank 78. It is contemplated that hydraulic system 76 may be connected to multiple separate fluid tanks 78 or to a single tank 78, as desired.

The valves of hydraulic system 76 may be disposed within a common or separate valve blocks (not shown) and include, for example, a first electro-hydraulic valve 90 and a second electro-hydraulic valve 92. First and second electro-hydraulic valves 90, 92 may be configured to selectively regulate flow of pressurized fluid to cylinders 34, 36. For example, in an exemplary embodiment, first electro-hydraulic valve 90 may be a tilt/pitch control valve and second electro-hydraulic valve 92 may be a tilt/pitch mode control valve. It should be understood however, that hydraulic system 76 may be configured in any manner, with any number of sources, valves, and other components, such that cylinders 34 and 36 may be extended and/or retracted to cause work tool 14 to tilt and/or pitch.

In an exemplary embodiment, first electro-hydraulic valve 90 may be a proportional flow valve that receives pressurized fluid from common supply passage 84 and distributes the fluid between head-end pressure chamber 70 of cylinder 34 and second electro-hydraulic valve 92 according to a selected proportion. Second electro-hydraulic valve 92 may be a directional valve configured to selectively distribute pressurized fluid to one or more chambers of cylinder 34 and cylinder 36. For example, second electro-hydraulic valve 92 may be configured to selectively distribute pressurized fuel to rod-end pressure chamber 72 of cylinder 34 and both head-end pressure chamber 70 and rod-end pressure chamber 72 of cylinder 36. Second electro-hydraulic valve 92 may be configured to move between different control positions that correspond to different control modes. For example, second electro-hydraulic valve may be movable between a single-tilt mode, a dual-tilt mode, and a pitch mode.

As shown in FIG. 2, controller 52 may be operatively connected to first and second electro-hydraulic valves 90, 92. Controller 52 may be configured to control first and second electro-hydraulic valves 90, 92 to control a flow of pressurized fluid to cylinders 34, 36. For example, controller 52 may be configured to transmit a signal to first and second electro-hydraulic valves 90, 92 to cause second electro-hydraulic valve 92 to move to a selected mode (e.g., pitch mode) and first electro-hydraulic valve 90 to distribute a certain proportion (e.g., equal amounts) of pressurized fluid between cylinder 34 and cylinder 36 (some of which may be directed through second electro-hydraulic valve 92). In this way, controller 52 may be configured to control hydraulic system 76 to tilt and/or pitch work tool 14.

In an exemplary embodiment, control system 19 may be configured to automatically control and correct a pitch of work tool 14. In particular, controller 52 may be configured to determine whether an actual pitch of work tool 14 (e.g., the current pitch of the work tool at a time it is determined) is equal to a desired pitch, and, if not, correct the actual pitch to the desired pitch. In an exemplary embodiment, controller 52 may be configured to determine a desired pitch of work tool by determining a current operating mode of machine 10, and determining a work tool pitch that corresponds to the current operating mode. For example, controller 52 may determine that machine 10 is in a carrying mode, and determine a pitch position that corresponds to carrying mode.

Pitch position may be defined by a cylinder displacement position of cylinder 34 and/or 36, although other criteria are possible (e.g., work tool position, cutting edge angle, relative work tool angle, etc.). As used herein, cylinder displacement position refers to a relative position of a rod 74 in a tube 66. The position may be defined in terms of distance from minimum retraction position, distance from maximum extension position, percent of maximum extension, etc.

In order to determine an actual pitch of work tool 14, control system 19 may be configured to measure an actual cylinder displacement position (e.g., the current cylinder displacement position at the time of the measurement) of at least one of cylinders 34, 36. As used herein, measuring refers to the determination or estimation of a parameter based on a measurement and/or calculation. In order to determine the actual cylinder displacement position of cylinder 34 and/or 36, control system 19 may further include one or more sensors 94 in communication with controller 52.

In an exemplary embodiment, the one or more sensors 94 may be configured and arranged to generate a signal indicative of one or more parameters associated with the pitch of work tool 14. For example, sensors 94 may be position sensors (e.g., in-cylinder rod/magnet sensors), one located in each of cylinders 34, 36 and configured to measure a cylinder displacement position of each cylinder 34, 36.

In another embodiment, controller 52 may be configured to determine a cylinder displacement position of cylinders 34, 36 by integrating a velocity of cylinders 34, 36 over time. In one embodiment, velocity of cylinders 34, 36 may be determined by measuring a flow velocity of pressurized fluid to each cylinder 34, 36. For example, sensors 94 may be flow measurement devices configured to measure flow velocity to each chamber of cylinders 34, 36. Based on the measured flow velocities, a velocity of cylinders 34 and/or 36 may be determined, which may be tracked over time and used to determine an actual cylinder displacement position.

Alternatively, controller 52 may be configured to measure flow velocity to each chamber of cylinders 34, 36 based on one or more known parameters, such as a volumetric flow rate of pressurized fluid from primary source 80 and an area of at least one pressure chamber 70, 72 of cylinders 34 and/or 36. In some embodiments, sensors 94 may include pressure sensors configured to measure a pressure of flow to cylinders 34, 36. Controller 52 may be configured to determine volumetric flow rate based on pressure measurements from sensors 94, which may be used to determine cylinder velocity, and, ultimately, actual cylinder displacement position.

INDUSTRIAL APPLICABILITY

The disclosed control system may be used with any machine having a work tool that is capable of both tilting and pitching. The disclosed control system may be particularly useful when applied to a machine (e.g., a dozer) having a work tool (e.g., a blade) where work tool pitch is important for efficient operation. The disclosed control system is adapted to correct instances in which an actual work tool pitch is not equal to a desired work tool pitch, thereby promoting simplified control and efficient operation of an associated machine. Operation of control system 19 will now be described in detail.

During operation, controller 52 may control electro-hydraulic valves 90, 92 to tilt and/or pitch work tool 14 according to one or more manual and/or automatic operations. For example, during a carrying mode operation in which work tool 14 may be carrying and/or pushing material (e.g., dirt), controller 52 may control electro-hydraulic valves 90, 92 to direct pressurized fluid to cylinders 34, 36 to set a pitch of work tool 14 to a carrying mode pitch. For example, controller 52 may control electro-hydraulic valves 90, 92 to cause cylinders 34, 36 to extend or retract to a position that corresponds to the carrying mode pitch.

As machine 10 operates in the carrying mode, controller 52 may initiate one or more tilt operations. Controller 52 may perform a tilt operation, for example, to steer machine 10 and/or the material being carried (such as to keep the machine and material within a work area or on a particular path). Controller 52 may control electro-hydraulic valves 90, 92 to extend one cylinder 34, 36 and/or retract another cylinder 34, 36 to tilt work tool 14 left and/or right to direct machine 10 and the material accordingly. Controller 52 may perform several tilt operations during performance of a carrying mode operation. After the carrying mode operation is completed, controller 52 may cause work tool 14 to move into a position with a pitch corresponding to another mode, such as for dumping the material and/or traveling to another location to start a new carrying mode operation. Machine 10 may cycle through one or more operations in this manner, such as to complete a task.

In some instances, however, the pitch of work tool 14 may inadvertently change during an operation (e.g., a carrying mode operation). For example, as tilt operations are performed, work tool "walkout" may occur, in which work tool 14 may inadvertently pitch outwardly. In particular, a tilt operation may result in one cylinder 34, 36 extending or retracting to a minimum or maximum displacement position, while the other cylinder continues to extend or retract. When the tilt operation is completed and the cylinders are returned to equal cylinder displacement positions, the effect of one cylinder reaching a minimum or maximum displacement position may not be compensated for, and work tool 14 may move to a pitch position that is different from the pitch position that it was in prior to beginning the tilt operation. These changes in pitch position may have a cumulative effect, resulting in work tool 14 deviating from a desired pitch position to a degree that reduces the efficiency of a machine operation. For example, in instances in which work tool 14 is a blade, "walkout" may cause a more aggressive cutting edge angle than what is desired for a carrying operation, resulting in machine 10 being less productive during that operation.

In an exemplary embodiment, controller 52 may be configured to perform one or more processes to correct work tool pitch when inadvertent changes (such as those cause by "walkout") occur. In order to determine whether a correction is required, controller 52 may compare a desired pitch of work tool 14 to an actual pitch of work tool 14, and adjust the actual pitch based on the comparison. For example, controller 52 may determine a difference between a desired pitch of work tool 14 and an actual pitch of work tool 14, compare the difference to a threshold value, and move one or more of electro-hydraulic valves 90, 92 to change the flow of pressurized fluid to cylinders 34, 36 to adjust the actual pitch of work tool 14 to the desired pitch, based on the comparison.

Controller 52 may be configured to determine a desired pitch of work tool 14 in any manner known in the art. For example, controller 52 may be configured to determine a desired cylinder displacement position that corresponds to the desired work tool pitch. Controller 52 may be configured to determine the desired cylinder displacement position by determining a current work tool mode, and determining the desired cylinder displacement position based on the current work tool mode. For example, controller 52 may determine a current work tool mode (e.g., carrying operation mode) and use one or more look-up tables to determine a cylinder displacement position that corresponds to the current work tool mode (e.g., a cylinder displacement position that corresponds to carrying operation mode).

Controller 52 may be configured to measure an actual pitch of work tool 14 in a variety of manners. For example, controller 52 may measure actual cylinder displacement positions of cylinder 34 and 36 using sensors 94, which may be position sensors arranged in each of cylinders 34, 36. Sensors 94 may generate a signal indicative of cylinder displacement position, which controller 52 may receive and interpret.

In another embodiment, controller 52 may be configured to measure actual cylinder displacement positions of cylinders 34 and 36 by measuring a flow of pressurized fluid to each pressure chamber 70,72 of cylinders 34, 36. For example, sensors 94 may be flow measurement devices configured to measure a velocity of a flow of pressurized fluid to cylinders 34 and 36, which controller 52 may use calculate cylinder displacement position (e.g., by integrating cylinder velocity over time).

In some embodiments, instead of directly measuring flow velocity with flow measurement devices, controller 52 may measure flow velocity using other measured or known parameters, such as volumetric flow rate and an area of head- and rod-end chambers 70, 72. Controller 52 may use the following algorithms to calculate cylinder velocity based on these parameters:

while tilting left:

$$V_{RtCyl} = \frac{Q_{pump}}{A_{RtHE}},\ V_{LtCyl} = -Q_{pump}\frac{A_{RtRE}}{A_{RtHE}A_{LtRE}},$$

while tilting right:

$$V_{RtCyl} = -Q_{pump}\frac{A_{LtRE}}{A_{LtHE}A_{RtRE}},\ V_{LtCyl} = \frac{Q_{pump}}{A_{LtHE}},$$

where $V_{RtCyl}$ is the velocity of cylinder 34, $V_{LtCyl}$ is the velocity of cylinder 36, $Q_{pump}$ is the volumetric flow rate from primary source 80, $A_{RtHE}$ is the area of head-end pressure chamber 70 of cylinder 34, $A_{RtRE}$ is the area of rod-end pressure chamber 72 of cylinder 34, $A_{LtHE}$ is the area of head-end pressure chamber 70 of cylinder 36, and $A_{LtRE}$ is the area of rod-end pressure chamber 72 of cylinder 36. In some embodiments, $Q_{pump}$, may be a known quantity (e.g., selected by controller 52), and/or may be calculated based on one or more signals from sensor(s) 94, which may be one or more pressure sensors.

Based on one or more of the measurement techniques described above, controller 52 may determine an actual cylinder displacement position of cylinders 34, 36, which may correspond to the actual pitch of work tool 14. It should be understood that controller 52 may measure the actual cylinder displacement of one of cylinders 34, 36 or both. In an exemplary embodiment, controller 52 may measure the cylinder displacement position of both cylinders 34, 36 and determine an average cylinder displacement position.

After determining the desired pitch of work tool 14 and the actual pitch of work tool 14, controller 52 may determine a difference between them. For example, controller 52 may compare the desired cylinder displacement position of cylinders 34, 36 to the measured displacement position of cylinders 34, 36, and determine the difference. In an exemplary embodiment, controller 52 may calculate a difference between an average cylinder displacement position of cylinders 34, 36 and a cylinder displacement position that corresponds to a current work tool mode. This difference may correspond to an inadvertent change in work tool pitch that may have occurred, such as changes due to work tool "walkout" and/or other factors.

In an exemplary embodiment, controller 52 may compare the determined difference to a threshold value, and adjust the pitch of work tool 14 based on the comparison. For example, if the difference is equal to or exceeds the threshold value, controller 52 may move one or more of electro-hydraulic valves 90, 92 to change the flow of pressurized fluid to first and second 34, 36 cylinders to adjust the actual pitch of the work tool to the desired pitch. In an exemplary embodiment, the threshold value may be defined in terms of cylinder displacement position. For example, the threshold value may be approximately 2 in. of cylinder displacement. In an exemplary embodiment, controller 52 may correct the pitch of work tool 14 by an amount approximately equal to the determined difference. The resulting correction may move the actual pitch of work tool 14 to the desired pitch.

In an exemplary embodiment, controller 52 may compare a difference between desired work tool pitch and actual work tool pitch at predetermined intervals, while machine 10 is operating in a carrying mode. In this way, controller 52 may compensate for inadvertent changes in pitch of work tool 14 during performance of an operation (e.g., a carrying mode operation). In some instances, controller 52 may determine that a tilt operation should be made while work tool pitch is being corrected (e.g., to steer machine 10). In an exemplary embodiment, controller 52 may give priority to the tilt operation and stop adjustment of the pitch of work tool 14 when the tilt operation is performed. After the tilt operation is completed, controller 52 may measure the actual work tool pitch again to determine if further correction is required (e.g., a pitch difference still exceeds the threshold).

Similarly, in some instances, controller 52 may determine that a non-compensating pitch operation (e.g., an operation to adjust the desired pitch of work tool 14 from one position to another) should be made while work tool pitch is being corrected. For example, controller 52 may receive a command from interface device 50 or an automatic control program to perform a non-compensating pitch operation while cylinders 34, 36 are performing an adjustment to correct the actual pitch to the desired pitch. In an exemplary embodiment, controller 52 may give priority to the non-compensating pitch operation and stop correcting adjustment of the pitch of work tool 14 when the non-compensating pitch operation is performed. After the non-compensating pitch operation is completed, controller 52 may measure the actual work tool pitch again and compare the result to the new desired pitch, and/or may completely suspend correcting the pitch of work tool 14 until the next carry cycle is conducted.

The exemplary disclosed control system 19 may include controller 52 configured to perform one or more of the processes described above to correct work tool pitch for a machine 10. In this way, control system 19 may compensate for any inadvertent changes in pitch, which may help prevent inefficient use of machine 10. Further, control of work tool 14 may be simplified, since an operator may not have to perform a manual operation to correct work tool pitch.

It will be apparent to those skilled in the art that various modifications and variations can be made to the control system of the present disclosure without departing from the scope of the disclosure. Other embodiments will be apparent to those skilled in the art from consideration of the specification and practice of the embodiments disclosed herein. It is intended that the specification and examples be considered as exemplary only, with a true scope of the disclosure being indicated by the following claims.

What is claimed is:

1. A control system for a machine, comprising:

a first cylinder operatively connected between a first side of a work tool and an undercarriage of the machine;

a second cylinder operatively connected between a second side of the work tool and the undercarriage of the machine;

one or more electro-hydraulic valves configured to selectively regulate flow of pressurized fluid to the first and second cylinders; and a controller configured to:

determine a current work tool mode, the current work tool mode being a carrying mode;

determine a desired pitch of the work tool based on the current work tool mode, the desired pitch of the work tool corresponding to the carrying mode;

determine a difference between the desired pitch of the work tool and an actual pitch of the work tool;

compare the difference to a threshold value; and move the one or more electro-hydraulic valves to change the flow of pressurized fluid to at least one of the first cylinder or the second cylinder to adjust the actual pitch of the work tool to the desired pitch, based on comparing the difference to the threshold value.

2. The control system of claim 1, wherein determining the difference between the desired pitch of the work tool and the actual pitch of the work tool includes:

determining a desired cylinder displacement position that corresponds to the desired pitch of the work tool, measuring an actual cylinder displacement position, and determining a difference between the desired cylinder displacement position and the actual cylinder displacement position.

3. The control system of claim 2, wherein the controller is further configured to determine the desired cylinder displacement position based on the current work tool mode.

4. The control system of claim 2, wherein the actual cylinder displacement position is an average displacement position of the first cylinder or the second cylinder.

5. The control system of claim 2, further including at least one sensor configured to generate a signal indicative of a parameter of work tool pitch, wherein the controller is in communication with the at least one sensor and is configured to determine the actual cylinder displacement position based at least on the signal.

6. The control system of claim 5, wherein the at least one sensor includes at least one position sensor and the parameter of work tool pitch is a displacement position of at least one of the first cylinder or the second cylinder.

7. The control system of claim 5, wherein the at least one sensor includes at least one flow measurement device and the parameter of work tool pitch is a velocity of pressurized fluid flowing from the one or more electro-hydraulic valves to at least one of the first cylinder and the second cylinder.

8. The control system of claim 2, wherein the controller is further configured to:

determine a volumetric flow rate of pressurized fluid and an area of at least one pressure chamber of at least one of the first cylinder or the second cylinder, determine a velocity of at least one of the first cylinder and the second cylinder based on the volumetric flow rate and the area, and determine the actual cylinder displacement position based on the velocity.

9. The control system of claim 8, further including at least one pressure sensor configured to generate a signal indicative of a pressure of the pressurized fluid, wherein the controller is in communication with the at least one pressure sensor and is configured to determine the volumetric flow rate based at least on the signal.

10. The control system of claim 1, wherein the controller is further configured to:

determine that a tilt operation or a non-compensating pitch operation is performed; and stop adjustment of the pitch of the work tool based on determining that the tilt operation or the non-compensating pitch operation is performed.

11. The control system of claim 1, wherein the controller is configured to adjust the pitch of the work tool to the desired pitch when the difference is equal to or exceeds the threshold value.

12. The control system of claim 1, wherein the work tool is a blade, bucket, or plow.

13. A method of controlling a work tool operatively connected to an undercarriage of a machine by a first cylinder and a second cylinder, the method comprising:

measuring an actual cylinder displacement position of at least one of the first cylinder and the second cylinder;

determining a current work tool mode, the current work tool mode being a carrying mode;

determining a desired pitch of the work tool based on the current work tool mode, the desired pitch of the work tool corresponding to the carrying mode;

determining a difference between the desired pitch of the work tool and an actual pitch of the work tool, the actual pitch of the work tool being based the actual cylinder displacement position;

comparing the difference to a threshold value; and moving one or more electro-hydraulic valves to change a flow of pressurized fluid to at least one of the first and second cylinders to adjust the actual pitch of the work tool to the desired pitch, based on comparing the difference to a threshold value.

14. The method of claim 13, wherein the actual cylinder displacement position is an average of actual cylinder displacement positions of the first cylinder and the second cylinder.

15. The method of claim 13, further including measuring the actual cylinder displacement position based on a signal from at least one position sensor.

16. The method of claim 13, further including measuring the actual cylinder displacement position based at least on a velocity of one or more of the first cylinder and the second cylinder.

17. The method of claim 13, further including stopping adjustment of the pitch of the work tool when a tilt operation or a non-compensating pitch operation is performed.

18. The method of claim 13, further including adjusting the pitch of the work tool to the desired pitch when the difference is equal to or exceeds the threshold value.

19. The method of claim 13, wherein the work tool is a blade, bucket, or plow.

20. A machine, comprising:

a first undercarriage assembly and a second undercarriage assembly;

an engine supported by the first undercarriage assembly and the second undercarriage assembly, the engine being configured to drive associated tracks;

a work tool;

a first push arm connected between the first undercarriage assembly and a first side of the work tool;

a second push arm connected between the second undercarriage assembly and a second side of the work tool;

a tank configured to hold a supply of fluid;

a pump driven by the engine to draw fluid from the tank and pressurize a main flow of fluid;

a first cylinder operatively connected between the first side of the work tool and the first push arm;

a second cylinder operatively connected between the second side of the work tool and the second push arm;

a first electro-hydraulic valve and a second electro-hydraulic valve configured to selectively regulate flow of pressurized fluid to the first and second cylinders; and a controller configured to:

determine a current work tool mode, the current work tool mode being a carrying mode;

determine a desired pitch of the work tool based on the current work tool mode, the desired pitch of the work tool corresponding to the carrying mode;

determine a difference between the desired pitch of the work tool and an actual pitch of the work tool;

compare the difference to a threshold value; and move one or more of the first and second electro-hydraulic valves to change the flow of pressurized fluid to at least one of the first and second cylinders to adjust the actual pitch of the work tool to the desired pitch, based on comparing the difference to the threshold value.

* * * * *